US005330655A

United States Patent [19]

Schweiss et al.

[11] Patent Number: 5,330,655

[45] Date of Patent: Jul. 19, 1994

[54] METHOD OF REGULATING A FLOTATION SYSTEM WITH A PRIMARY AND SECONDARY STAGE

[75] Inventors: Peter Schweiss, Elchingen; Hans-Dieter Dorflinger, Heidenheim, both of Fed. Rep. of Germany

[73] Assignee: J.M. Voith GmbH, Heidenheim, Fed. Rep. of Germany

[21] Appl. No.: 100,483

[22] Filed: Jul. 30, 1993

[30] Foreign Application Priority Data

Jul. 30, 1992 [DE] Fed. Rep. of Germany ..... 4225117

[51] Int. Cl.[5] ..... B03D 1/02; B03D 1/08

[52] U.S. Cl. ..... 210/703; 210/712; 210/713; 210/718; 210/741; 210/744; 210/805; 210/195.1; 209/1; 209/164; 162/4

[58] Field of Search ..... 210/703, 712, 713, 718, 210/741, 744, 805, 195.1; 209/1, 164; 162/4, 252

[56] References Cited

U.S. PATENT DOCUMENTS 1,457,077 5/1923 Janney .
1,886,979 11/1932 Ruth .
2,005,742 6/1935 Hines .
4,563,274 1/1986 Rothon ..... 210/101
4,952,308 8/1990 Chamberlin .
5,188,726 2/1993 Jameson .

FOREIGN PATENT DOCUMENTS 1015869 8/1977 Canada .
0391042B1 2/1990 European Pat. Off. .
598643 3/1978 U.S.S.R. .
738670 6/1980 U.S.S.R. .
755312 8/1980 U.S.S.R. .
854449 8/1981 U.S.S.R. .

OTHER PUBLICATIONS

Pfalzer, Lothar; "Deinking of Secondary Fibers" TAPPI, Sep. 1980 vol. 63, No. 9, pp. 113–116.

*Primary Examiner*—Thomas M. Lithgow
*Attorney, Agent, or Firm*—Baker & Daniels

[57] ABSTRACT

The invention is directed to a method of regulating a flotation system having an inflow quantity of suspension flow dependent on production demands, including a primary flotation stage and a secondary flotation stage where the secondary flotation stage treats the froth of the primary stage, transporting de-aereated froth from the primary flotation stage to a collection vessel which is in fluid communication the secondary flotation stage; recycling suspension flow from the secondary flotation cells of the secondary flotation stage in part to an inlet of the primary flotation stage, and in part to an inlet of the secondary flotation stage, and regulating the level of de-aereated froth in the collection vessel by controlling the amount of suspension flow recycled from said secondary flotation stage to the inlet of the secondary flotation stage.

2 Claims, 1 Drawing Sheet

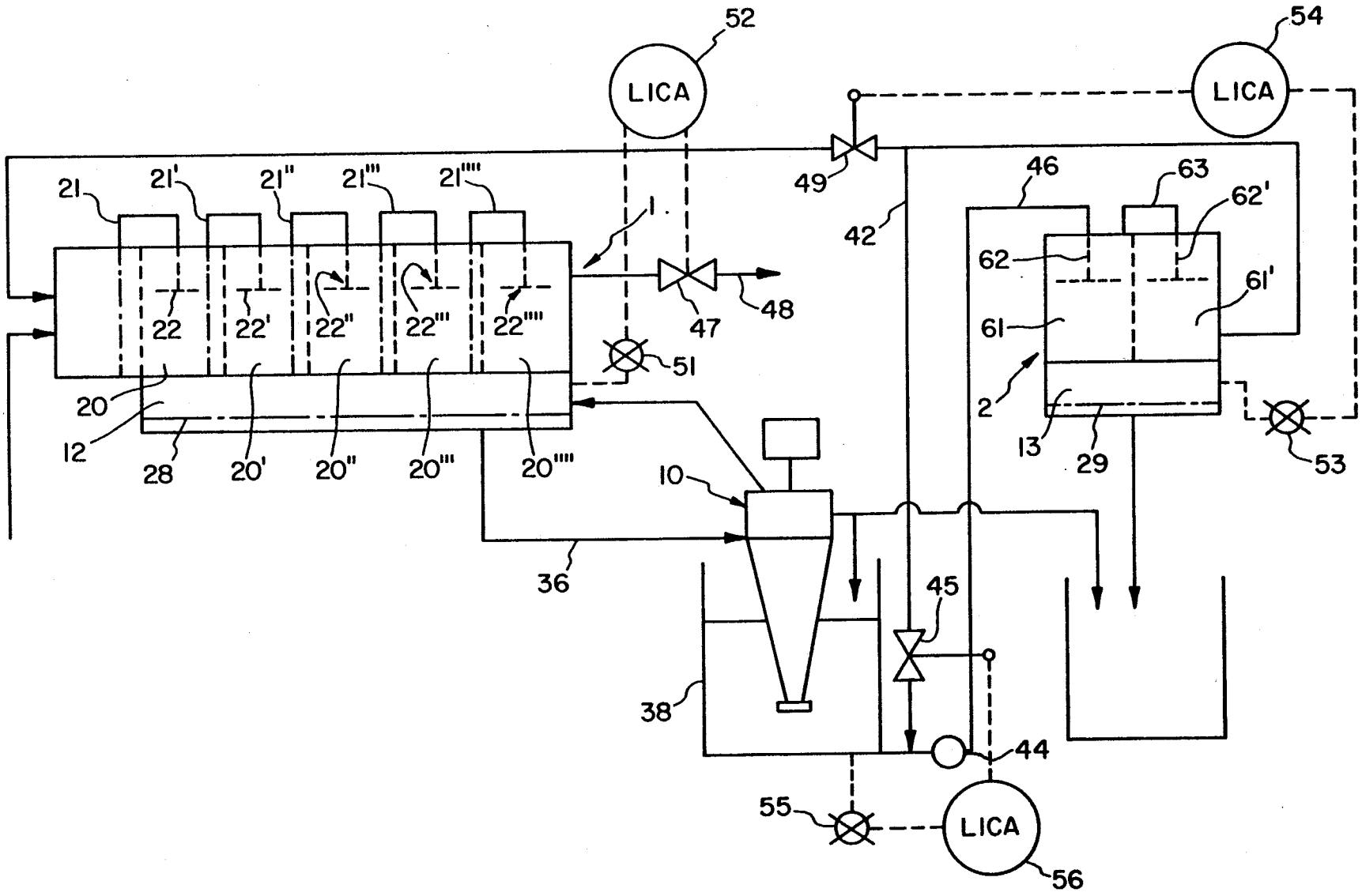
LICA
LICA
LICA
54
53
62'
61'
63
29
46
62
61
2
13
56
44
45
42
49
55
48
47
51
52
10
38
36
1
20''''
22''''
21''''
20'''
22'''
21'''
20''
22''
21''
20'
22'
21'
28
22
21
20
12

METHOD OF REGULATING A FLOTATION SYSTEM WITH A PRIMARY AND SECONDARY STAGE

BACKGROUND OF THE INVENTION

The present invention concerns the regulation of a flotation system.

A difficulty with conventional systems consists in the regulation of the two flotation stages because of the amount of froth produced and the bubbly suspension to be flotated. With known regulation methods it is necessary to constantly monitor the amounts of cell overflow at the point of origin and to effect a correction of the level set values.

SUMMARY OF THE INVENTION

The invention comprises, in one form, a method of regulating a flotation system having an inflow quantity of suspension flow dependent on production demands, including the steps of determining a back-up level of the froth in a froth chute of a primary flotation stage; dependent on the back-up level, adjusting an overflow level of suspension flow to the froth chute in the primary flotation stage; dependent on the back-up level, controlling the suspension flow in the primary flotation stage to provide a substantially constant back-up level of the froth in the froth chute of the primary flotation stage; transporting de-aereated froth from the primary flotation stage to a collection vessel which is in fluid communication with the secondary flotation stage; recycling suspension flow from the secondary flotation cells of the secondary flotation stage in part to an inlet of the primary flotation stage, and in part to an inlet of the secondary flotation stage; regulating the level of de-aereated froth in the collection vessel by controlling the amount of suspension flow recycled from said secondary flotation stage to the inlet of the secondary flotation stage; and regulating the ratio of the amount of said suspension flow from the secondary flotation cells which is transported to the inlet of the primary flotation stage relative to the amount of said suspension flow which is transported to the inlet of the secondary flotation stage, dependent on the height of froth in the froth chute of the secondary flotation stage.

The following principle of regulation results:

Regulation of the cell overflow amount by measuring the level of the primary froth chute, and indirect level regulation of the primary froth chute by variation of the quantity of accepts (primary cell level) while the amount of flotation influx is kept constant (flow regulation).

A constant back-up level also means a constant overflow amount, due to the measuring weir in or at the end of the froth chute.

Measuring the primary cell level serves only as an additional control indication.

Advantages of the present invention include:

The froth chute level (low volume) reacts sensitively to variations of the primary overflow amount, for which reason the primary overflow amount can be adjusted very accurately and consistently via the bypass valve.

The secondary stage, owing to the constant froth chute level, receives always a constant amount, so that the secondary overflow amount and the amount of reflux suspension are extensively constant.

While due to the "froth chute regulation" of the primary stage the inflow to the secondary stage is constant, the content of air in the secondary stage may vary, whereby the amount of overflow, despite unchanged level transmitter indication, may vary.

This effect can be extensively eliminated by the "froth chute regulation" at the secondary stage.

The regulation of the secondary cell overflow amount takes place by measuring the secondary froth chute level before an outlet weir (vertical slot of about 15 mm width), while an indirect level regulation of the secondary froth chute is effected by variations of the amount of reflux suspension.

There is a direct and reproducible correlation (unobstructed outflow behind the weir) between the back-up level (froth chute level) before the weir and the amount of flow passing through the weir, for which reason the secondary overflow amount can be established by adjustment of the froth chute level.

The froth chute level (low volume) reacts so sensitively to variations of the overflow amount that the effect of different air contents in the overflow suspension is negligibly small, with a reproducible correlation resulting between froth chute level and overflow amount.

BRIEF DESCRIPTION OF THE DRAWINGS

The invention will be explained hereafter with the aid of the drawing FIGURE, which is a schematic illustration of one embodiment of the present invention.

DETAILED DESCRIPTION OF THE INVENTION

The primary flotation stage 1, after the mixing chamber, consists essentially of the individual, serially arranged flotation cells 20, 20', etc., with each of which there is coordinated an injector 22, 22' or other feed apparatus for the suspension to be flotated. The feed lines to the injectors are referenced 21, 21' etc. Common to all flotation cells is here a froth chute 12, to which the purified suspension proceeds over a weir of each flotation cell. Moreover, primary stage 1 features in froth chute 12 or at the end of froth chute 12 a measuring weir 28.

Secondary flotation stage 2 is structured similarly to primary flotation stage 1, with individual flotation cells 61, 61' injectors 62, 62' the transition between the two cells taking place via line 63. Provided here as well is a froth chute 13, which is preceded by a weir 29. Here, too, a measuring weir 29 is located at the end of, or within, froth chute 13. Before measuring weirs 28, 29, the levels are preferably measured each by pressure sensors 51, or 53. Regulators 52, or 54, for one, regulate the amount of accepts of the primary stage via valve 47, and the amount of reflux to primary flotation stage 1, from the secondary flotation stage 2 via valve 49. The amount of froth, or overflow, of the primary stage is via line 36 channeled to a hydrocyclone 10, which assumes the deaeration of the bubbly suspension. With its tapered end it dips into a vessel 38 from which a pump 44 forces the suspension into the line 46. A pressure sensor 55, a regulator 56 and a valve 45 in line 42, through which latter a circulated amount (in the bypass) is passed to the secondary flotation stage 2, serve to keep the level in the vessel 38 constant.

The adjustment of the weirs in, or on, the individual flotation cells remains essentially constant, and the quantities controlled by the regulators are changed alone, in keeping with the production quantity called for. This makes for simple and clear conditions of regulation.

What is claimed is:

1. A method of regulating a flotation system having an inflow quantity of suspension flow dependent on production demands, said flotation system including a primary flotation stage having a plurality of primary flotation cells, and a froth chute in communication with each of said primary flotation cells, each said primary flotation cell having a froth overflow device; and a secondary flotation stage having a plurality of secondary flotation cells, and a froth chute in communication with each of said secondary flotation cells; said method comprising the steps of:

feeding said inflow quantity of suspension to said primary flotation stage and forming a froth in said primary froth chute;

determining an overflow level of the suspension flow to the froth chute in the primary flotation stage;

dependent on said overflow level, adjusting a back-up level of the froth in the froth chute of the primary flotation stage;

dependent on said back-up level, controlling accepts from an outlet of said primary flotation stage to provide a substantially constant back-up level of the froth in the froth chute of the primary flotation stage;

de-aereating the froth from the froth chute of the primary flotation stage;

transporting the de-aereated froth to a collection vessel which is in fluid communication with an inlet to the secondary flotation stage;

recycling suspension flow from the secondary flotation cells of the secondary flotation stage in part to an inlet of the primary flotation stage, and in part to the inlet of the secondary flotation stage;

regulating the level of de-aereated froth in the collection vessel by controlling the amount of suspension flow recycled from said secondary flotation stage to the inlet of the secondary flotation stage;

measuring a height of the froth in the froth chute of the secondary flotation stage before an outflow weir associated therewith; and regulating the ratio of the amount of said suspension flow from the secondary flotation cells which is transported to the inlet of the primary flotation stage relative to the amount of said suspension flow which is transported to the inlet of the secondary flotation stage, dependent on said measuring step.

2. The method of claim 1, wherein said transporting step comprises transporting said de-aereated froth to a collection vessel having a pump disposed in fluid communication with an outlet thereof and with the inlet to the secondary flotation stage.

* * * * *